US009391373B2

(12) United States Patent
Ehrenberg et al.

(10) Patent No.: US 9,391,373 B2
(45) Date of Patent: Jul. 12, 2016

(54) INFLATABLE ANTENNA

(75) Inventors: Robert G. Ehrenberg, Torrance, CA (US); Sujal Sampat, Chino Hills, CA (US)

(73) Assignee: The Boeing Company, Chicago, IL (US)

( * ) Notice: Subject to any disclaimer, the term of this patent is extended or adjusted under 35 U.S.C. 154(b) by 485 days.

(21) Appl. No.: 13/556,820

(22) Filed: Jul. 24, 2012

(65) Prior Publication Data

US 2014/0028532 A1 Jan. 30, 2014

(51) Int. Cl.

| | |
|---|---|
| ***H01Q 1/08*** | (2006.01) |
| ***H01Q 1/12*** | (2006.01) |
| ***H01Q 15/16*** | (2006.01) |
| ***H01Q 19/19*** | (2006.01) |
| ***H01Q 3/08*** | (2006.01) |

(52) U.S. Cl.

CPC ..... *H01Q 15/163* (2013.01); *H01Q 1/081* (2013.01); *H01Q 1/1235* (2013.01); *H01Q 3/08* (2013.01); *H01Q 19/19* (2013.01); *Y10T 29/49016* (2015.01)

(58) Field of Classification Search

CPC ..... H01Q 1/08; H01Q 1/081; H01Q 1/082; H01Q 19/18; H01Q 19/19; H01Q 19/191–19/193; H01Q 15/14; H01Q 15/16; H01Q 15/161–15/163; H01Q 1/12; H01Q 1/1207; H01Q 1/1228

USPC ..... 343/912, 871, 892

See application file for complete search history.

(56) References Cited

U.S. PATENT DOCUMENTS

| | | | | |
|---|---|---|---|---|
| 3,286,267 | A * | 11/1966 | Lutchansky | 343/781 R |
| 4,672,389 | A * | 6/1987 | Ulry | F24J 2/1052 343/880 |
| 5,793,334 | A * | 8/1998 | Anderson | H01Q 13/02 333/126 |
| 6,262,691 | B1 * | 7/2001 | Austin | H01Q 1/1221 343/878 |
| 6,462,718 | B1 | 10/2002 | Ehrenberg et al. | |
| 6,630,912 | B2 | 10/2003 | Ehrenberg et al. | |

(Continued)

FOREIGN PATENT DOCUMENTS

| | | |
|---|---|---|
| JP | S51139746 A | 12/1976 |
| JP | 200196844 | 7/2001 |
| JP | 2011171803 | 9/2011 |

OTHER PUBLICATIONS

UK Patent Office, British Application No. GB1311935.9 Combined Search and Examination Report dated Sep. 27, 2013, pp. 1-12.

*Primary Examiner* — Dameon E Levi
*Assistant Examiner* — Jennifer F Hu
(74) *Attorney, Agent, or Firm* — Charles L. Moore; Moore & Van Allen PLLC

(57) ABSTRACT

An inflatable structure usable as a satellite terminal. An inflatable structure may include an inflatable membrane for forming the structure and two integral RF reflective portions. When the membrane is inflated, the two RF reflective portions oppose each other to form an antenna. One RF reflective portion may be a main reflector and the other RF reflective portion may be a subreflector, both reflectors curvatures that face each other to form a Gregorian antenna or a Cassegrain antenna. In another embodiment, an inflatable antenna may include an inflatable dish including a RF reflective main reflector and an opposing RF transparent dish wall. An inflatable RF transparent support member and an RF reflective subreflector extend from the dish wall. Again, when the antenna is inflated, the main reflector and the subreflector oppose each other to reflect RF energy toward each other to form an antenna.

21 Claims, 7 Drawing Sheets

(56) References Cited

U.S. PATENT DOCUMENTS 6,848,796 B2 * 2/2005 Tagirov ..... B64G 1/1007 359/846
6,963,315 B2 11/2005 Gierow et al.
7,382,332 B2 * 6/2008 Essig, Jr. ..... F21S 11/00 342/10
2004/0207566 A1 10/2004 Essig, Jr.
2005/0007287 A1 * 1/2005 Balaji ..... H01Q 13/025 343/772
2009/0002257 A1 * 1/2009 de Jong ..... B64G 1/222 343/872
2011/0074652 A1 * 3/2011 Lewry ..... H01Q 1/125 343/882

* cited by examiner

INFLATABLE ANTENNA

FIELD

The present disclosure relates to satellite terminals, and more particularly to satellite terminals including antennas that are inflatable and may be portable with relatively low weight and small storage requirements.

BACKGROUND

High capability satellite terminals for communications are, in general, relatively very large, heavy, and expensive. While the physical characteristics of such terminals are not as critical for vehicle-mounted terminals, it is desirable in some circumstances for the terminals to be manually transported by a person, i.e., man-portable. In some cases, weight may be decreased by making the units smaller or using lighter materials, but certain antenna aperture sizes are needed to achieve useful data rates. When the antenna is made smaller, the combination of amplifier and up-converter, such as a Block Up-Converter (BUC), associated with the terminal needs to be made larger for transmission to be adequate. A larger BUC requires additional batteries, which increases weight, contradicting the purpose of reducing the size of the antenna. With respect to lighter materials, 1.2 meter dishes can be made to disassemble and can be made of lightweight plastic, but the precision of manufacturing involved has made this type of production expensive, and to an extent cost-prohibitive.

The laws of radio frequency (RF) transmission physics pose a strategic design dilemma for achieving increased digital transmission speed. Increased transmission speed requires any or all of increased dish size, increased transmission power, decreased transmission losses, or decreased system-wide link noise. Accordingly, apparatus is needed that provides adequate transmission speed, factoring in the above criteria, combined with the ability for the apparatus to be man-portable.

SUMMARY

In accordance with an embodiment, an inflatable structure is provided. The inflatable structure includes an inflatable membrane for forming the structure, a first RF reflective portion integral to the inflatable membrane, and a second RF reflective portion integral to the inflatable membrane. When the membrane is inflated, the first RF reflective portion and the second RF reflective portion oppose each other to form an antenna.

In some embodiments, the inflatable membrane is made or assembled to be in one piece. In some embodiments, the first RF reflective portion comprises a main reflector and the second RF reflective portion comprises a subreflector, and the main reflector includes a first concave surface and the subreflector includes a second concave surface. The first concave surface and the second concave surface are spaced from and oppose each other to form a Gregorian antenna. In other embodiments, the first RF reflective portion comprises a main reflector and the second RF reflective portion comprises a subreflector, and the main reflector includes a concave surface and the subreflector includes a convex surface. The concave surface and the convex surface are spaced from and oppose each other to form a Cassegrain antenna.

In some embodiments, the inflatable membrane can be compressed and compacted and subsequently inflated one or more times without substantially altering the original inflated shape of the membrane or the reflective efficiency of the first RF reflective portion and the second RF reflective portion.

In accordance with another embodiment, an inflatable antenna may include an inflatable dish including a radio frequency (RF) reflective main reflector and an opposing RF transparent dish wall. An RF transparent support member extends from the RF transparent dish wall away from the main reflector and has a free end. An RF reflective subreflector is proximate and attached to the free end of the RF transparent support member, and the support member and the subreflector are inflatable. When the antenna is inflated, the main reflector and the subreflector oppose each other to reflect RF energy toward each other to form an antenna. In some embodiments, the main reflector and the RF transparent dish wall define a dish interior volume, the subreflector and the RF transparent support member define a support member interior volume, and the dish interior volume and the support member interior volume are in fluid communication.

In accordance with another embodiment, a method of making an inflatable antenna may include providing material for forming an inflatable structure. A first portion and a second portion of the material are caused to be RF reflective. The material is assembled to form an inflatable membrane. When the membrane is inflated, the first portion and the second portion oppose each other to form an antenna.

Other aspects and features of the present disclosure, as defined solely by the claims, will become apparent to those ordinarily skilled in the art upon review of the following non-limited detailed description of the disclosure in conjunction with the accompanying figures.

BRIEF DESCRIPTION OF THE SEVERAL VIEWS OF THE DRAWINGS

The following detailed description of embodiments refers to the accompanying drawings, which illustrate specific embodiments of the disclosure. Other embodiments having different structures and operations do not depart from the scope of the present disclosure.

DESCRIPTION

Figure 1:
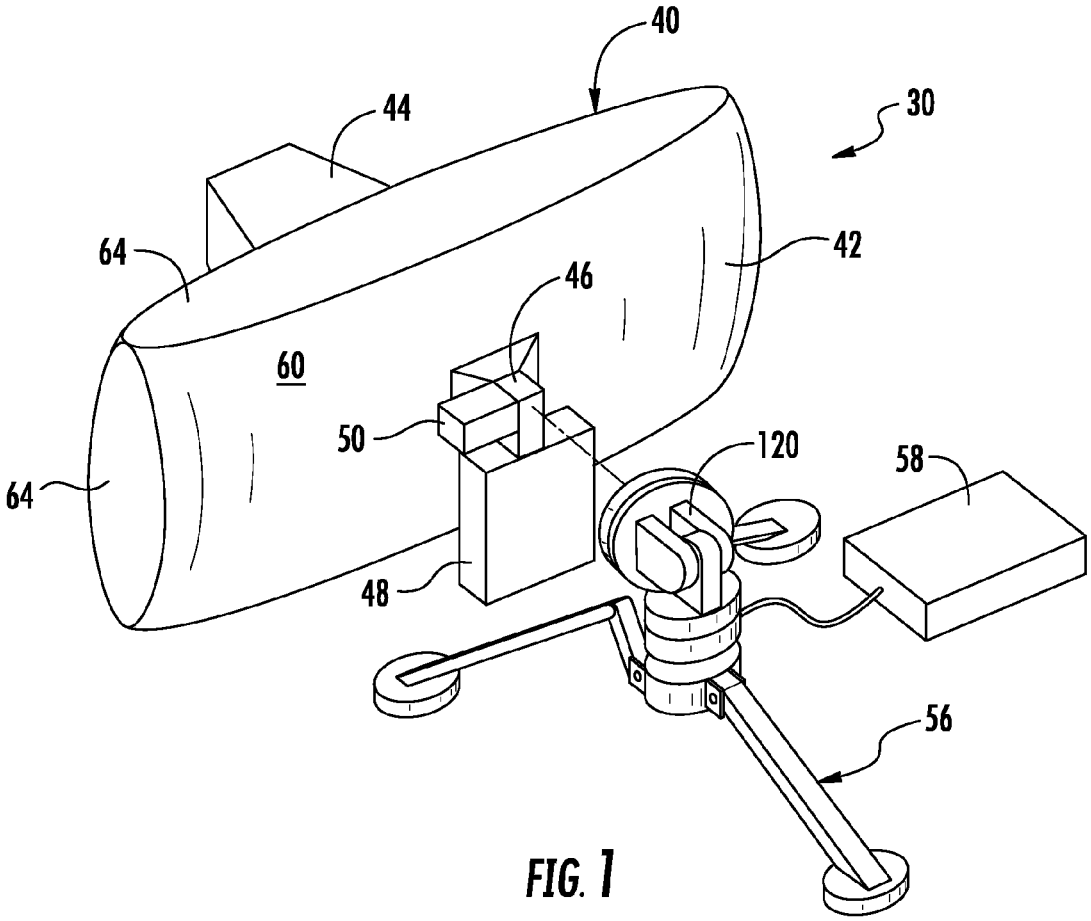
FIG. 1 is a rear perspective view of an embodiment of a communications terminal including a first embodiment of an inflatable antenna assembly with a base in accordance with the present disclosure.

The following detailed description of embodiments refers to the accompanying drawings, which illustrate specific embodiments of the disclosure. Other embodiments having different structures and operations do not depart from the scope of the present disclosure. Like reference numerals may refer to the same element or component in the different drawings.

Certain terminology is used herein for convenience only and is not to be taken as a limitation on the embodiments described. For example, words such as "front," "rear," "top," "bottom," "upper," "lower," "left," "right," "horizontal," "vertical," "upward," and "downward" merely describe the configuration shown in the figures or relative positions. The referenced components may be oriented in any direction and the terminology, therefore, should be understood as encompassing such variations unless specified otherwise.

Figure 2:
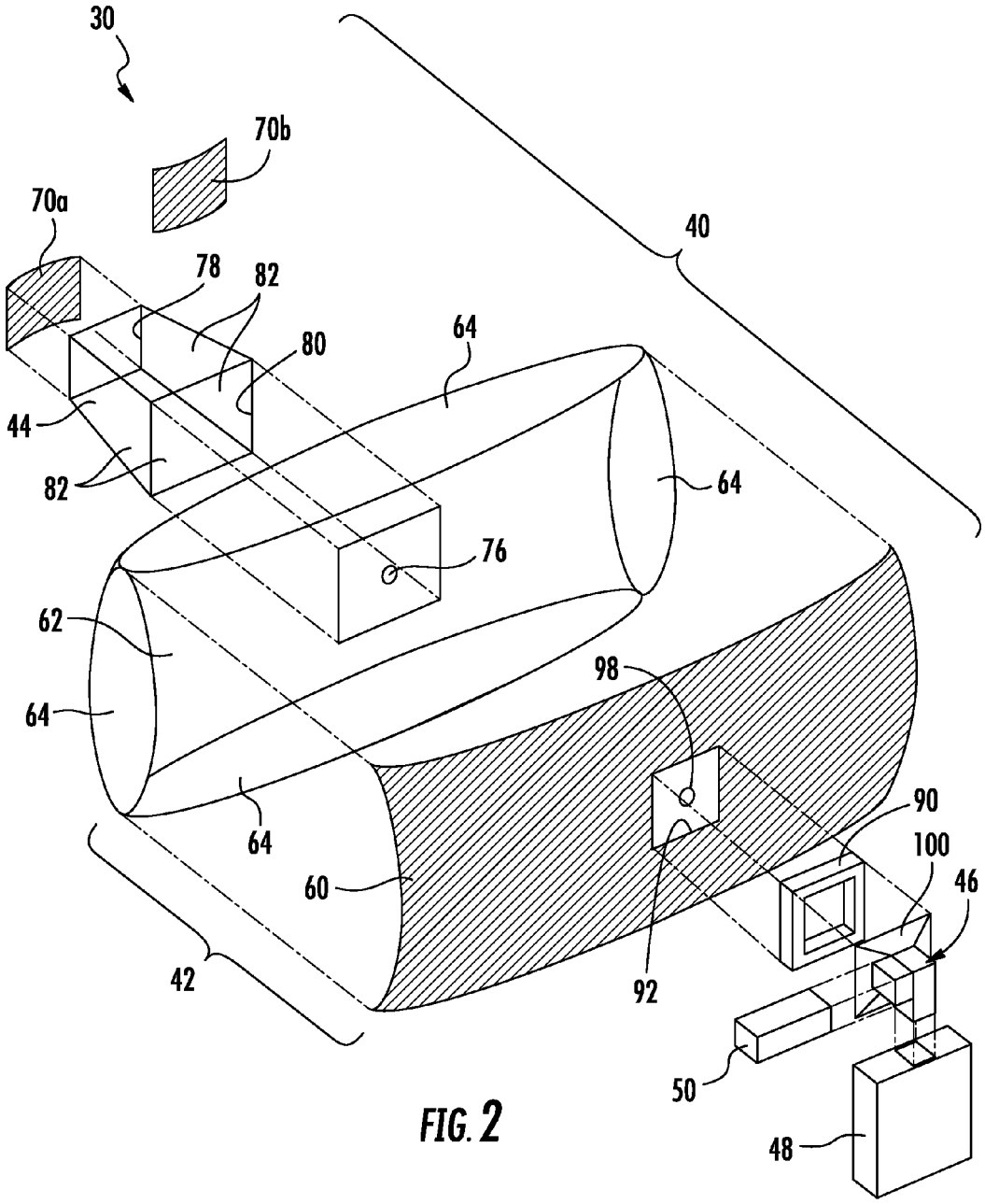
FIG. 2 is an exploded view of the inflatable antenna assembly of FIG. 1.

Referring now to the drawings, wherein like reference numerals designate corresponding or similar elements throughout the several views, FIG. 1 shows an embodiment of an inflatable antenna assembly 30 including an antenna 40 with an inflatable dish 42 that substantially rectangular in one plane to provide higher gain in the horizontal axis than in the vertical axis of that plane, and an inflatable support member 44. The antenna assembly 30 also includes transmission and reception elements including a horn/OMT/waveguide 46, a transmitter 48, and a receiver 50. The antenna assembly 30 is shown disassembled from its tripod base 56 and modem 58, and in FIG. 2 the antenna assembly 30 is shown with its components separated. The inflatable antenna dish 42 includes at least an RF reflective membrane at the rear that is the main reflector 60, and an RF transparent membrane 62 at the front. There may also be RF transparent sides 64 as necessary to realize the desired shape of the main reflector 60. When the term "RF reflective" is used herein, it should be understood that the membrane is in actuality substantially RF reflective, reflecting RF energy in an amount that is adequate for the successful performance of the antenna, as opposed to being perfectly reflective. Likewise, when the term "RF transparent" is used herein, it should be understood that the membrane is in actuality substantially RF transparent, allowing RF energy to pass through in an amount that is adequate for the successful performance of the antenna, as opposed to being perfectly transparent.

The inflatable dish 42 defines an interior volume. The main reflector 60 is concave frontward. In addition to the main reflector 60, the inflatable support member 44 supports a subreflector 70*a* that is RF reflective and may be an RF reflective membrane is provided at the end of the inflatable support member 44. The support member 44 may also be a membrane, and with the subreflector 70*a* defines an interior volume that is in fluid communication with the interior volume of the dish 42, which occurs in the example shown through an opening 76 between the two interior volumes to effectively create a larger interior volume. The support member 44 in this embodiment may have a substantially rectangular front 78 and rear 80, and may have four sides 82 that taper from back to front. The sides 82 of the support member 44 are RF transparent. The subreflector 70*a* may be at the front end of the support member 44 and may also be rectangular. The subreflector 70*a* may be concave toward the dish 42, resulting in a dish 42 and subreflector 70*a* that are concave toward each other to form a Gregorian antenna. Alternatively, the subreflector may take the shape shown as the second subreflector 70*b* in FIG. 2, which is convex toward the dish 42, while the dish 42 remains concave toward the subreflector 70*b*. This results in a dish 42 and subreflector 70*b* that form a Cassegrain antenna.

The antenna 40 may be made of any flexible material for forming a membrane that will contain a gas and includes, but is not limited to, such materials, for example, as Mylar, fiber reinforced material with a weave, thin film doped or vapor deposited, or aluminized rubber fabric. In addition, the material will preferably (a) hold its shape after being folded, rolled, compressed, or compacted, (b) be capable of being coated with a smooth, highly RF reflective substance to make it suitable as an antenna, (c) be RF transparent when without RF reflective coating, and (d) when RF reflective coating is applied, be capable of being compressed and compacted and subsequently being uncompressed and uncompacted one or more times without affecting its original and desired inflated shape or ability to efficiently reflect RF energy. The RF reflective main reflector 60 and the RF reflective subreflector 70*a* are both integral to the membrane and may be made by the application of RF reflective coating to the membrane, which when fabricated may all be one piece of material. The subreflector 70*a*, 70*b* may be made of RF reflective-coated solid material that holds its shape when the antenna 40 is not inflated, including but not limited to a plastic. This is particularly relevant to the convex subreflector 70*b*, which as a membrane would not hold a convex shape when the antenna 40 is inflated. The relatively small size of the subreflector 70*a*, 70*b* may provide the ability for a solid subreflector not to damage the membrane when the antenna 40 is compressed and expanded, which in some embodiments may happen repeatedly. Rounded corners and edges on a rectangular solid subreflector 70*a*, 70*b* may be desirable.

In one method of fabrication, the antenna 40 may be constructed out of multiple flexible elements and bonded together after RF reflective coating has been applied to the inner surface of the main reflector 60 and the inner surface of the subreflector 70*a*, 70*b*. The dish 42 and support member 44 may be, as one method vacuum form molded with high precision and relatively low cost, and may be filled with, for example, a dry gas or two-part, hardening, RF transparent foam. If two part hardening foam is used, it is understood that the inflatable antenna will not be collapsible and compactable after inflation, however, the other attributes of the antenna will still apply, such as light weight and high gain. If used, the hardening foam will supply an additional benefit of stiffness of the antenna structure in windy conditions. Bonding must be airtight to allow inflation of the antenna 40 with any dry gas or foam. A gas could be discharged, for example, from a $CO_2$ cartridge into the antenna 40. Alternatively, the two part foam could be discharged into the antenna 40 from two small, pressurized canisters.

With respect to the transmission and reception elements, in this example a transmitter 48 and receiver 50 are mounted to the horn/OMT/waveguide 46, which in turn is mounted to the tripod base 56, as will be discussed in greater detail below. A mounting frame 90 is provided that may be attached to the back of the main reflector 60 at a central position with a permanent, airtight bond. In this embodiment, the mounting frame 90 is rectangular. The area of the main reflector 60 that is within the limits of the mounting frame 90 has no RF reflective material applied to it and accordingly is an RF transparent region 92, as may be accomplished by masking this area when the RF reflective material is applied to the rest of the main reflector 60. Therefore, the RF transparent region 92 allows RF energy to pass in and out of the horn/OMT/waveguide 46.

Figure 3:
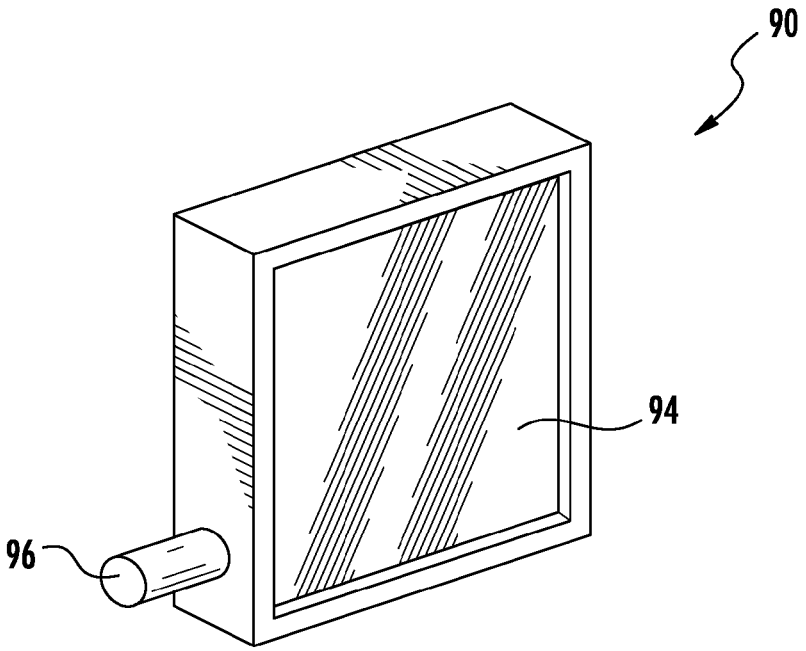
FIG. 3 is a perspective view of an example of a mounting frame of the inflatable antenna assembly of FIG. 1.

As shown in FIG. 3, the mounting frame 90 provides an airtight pressure window 94 (not shown in FIG. 2) and a valve 96 (also not shown in FIG. 2) that communicates with the front side of the window 94. The valve 96 may be a Schrader valve or any airtight check valve of suitable size for admission of dry gas or two part foam. With the mounting frame 90 bonded in place, a source of dry gas or two part foam may be connected to the valve 96. The gas or foam may pass through the valve 96, to the front side of the window 94, through an opening in the main reflector 60 in the RF transparent region 92 to inflate the dish 42, and also through the opening 76 between the front, RF transparent membrane 62 of the dish 42 and the back 80 of the support member 44 to inflate the support member 44. Thus, the entire antenna 40 may be inflated from one valve 96. It should be understood that alternative port locations for a valve could be provided, such as, for example, a port directly into a horn/OMT/waveguide with a flow path for gas or two part foam to get into the antenna. In such an alternative configuration, an opening could be provided in the mounting frame in place of the pressure window to allow entry of the gas or foam into the dish 42 and an airtight seal would be needed between the mounting frame 90 and the horn/OMT/waveguide 46. Additional airtight pressure windows would then be needed on the horn/OMT/waveguide's 46 receiver port and transmitter port.

Figure 4:
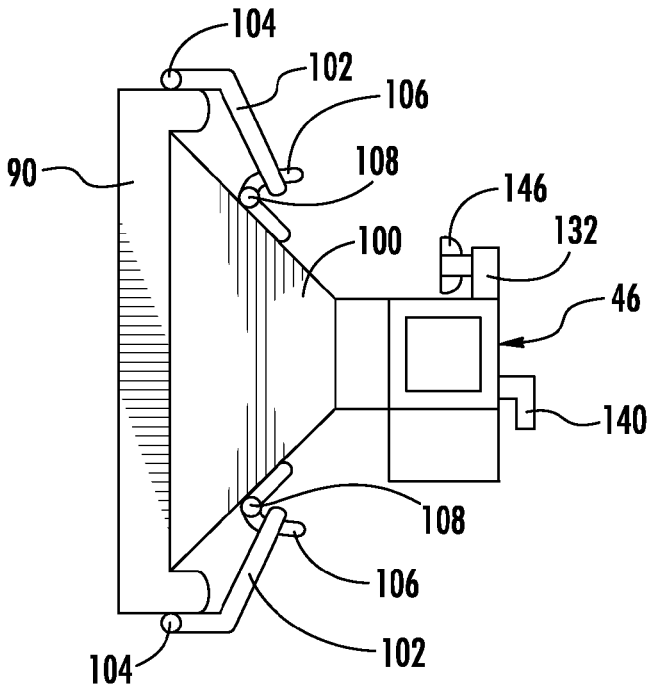
FIG. 4 is a side view of the exemplary mounting frame of FIG. 3 assembled to an exemplary assembly of a horn, orthomode transducer (OMT), and waveguide, referred to herein as a horn/OMT/waveguide, of FIG. 1.

In FIG. 4, the mounting frame 90 is shown mounted to the horn/OMT/waveguide 46. The opening of the horn 100 is rectangular and accommodates the mounting frame 90. While omitted from other figures, an example of apparatus for mounting the mounting frame 90 to the horn/OMT/waveguide 46 is shown in FIG. 4. Clips 102 that may be loops may be pivotally attached with hinges 104 to the top and bottom of the mounting frame 90. Latches 106 that also pivot at hinges 108 may be attached to the horn 100. The clips 102 may be positioned over the latches 106, and the latches 106 may be pivoted rearward to secure the clips 102 and pull the mounting frame 90 to a tight fit with the horn 100. Other means, such as captured thumbscrews, may be used. Preferably the mounting means used provides components that do not detach from the mounting frame 90 or horn 100, which avoids the possibility of loss of those parts or searching for them when dropped.

Figure 5:
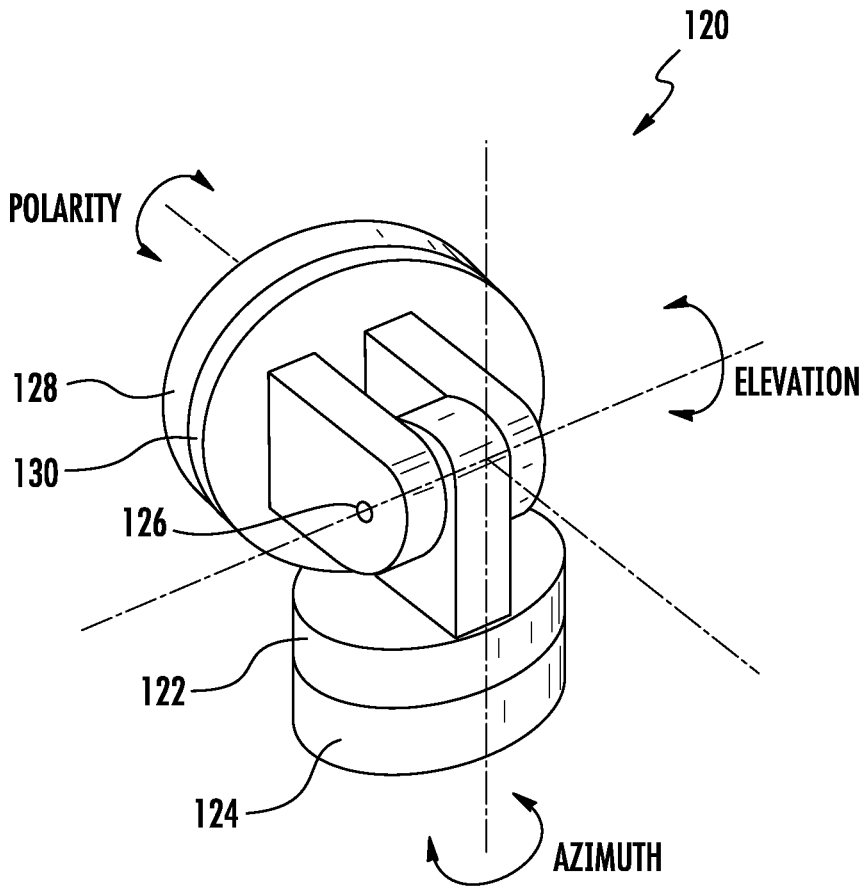
FIG. 5 is a perspective view of an example of a gimbal of the support of FIG. 1.

FIG. 5 shows the gimbal 120 of the tripod base 56. In one embodiment, the gimbal 120 is motorized, but the gimbal 120 could alternatively be manually controlled, in which case degree markings on the azimuth, elevation and polarity axis and a level, such as a two axis bubble level, could be provided. The gimbal 120 provides three axis control of azimuth, elevation, and polarity. Azimuth adjustment may be provided by relative rotation of horizontal plates 122, 124. Elevation adjustment may be provided by pivoting at a hinge 126. Polarity adjustment may be provided by rotation of a front, polarity rotation plate 128 relative to a back plate 130.

Figure 6:
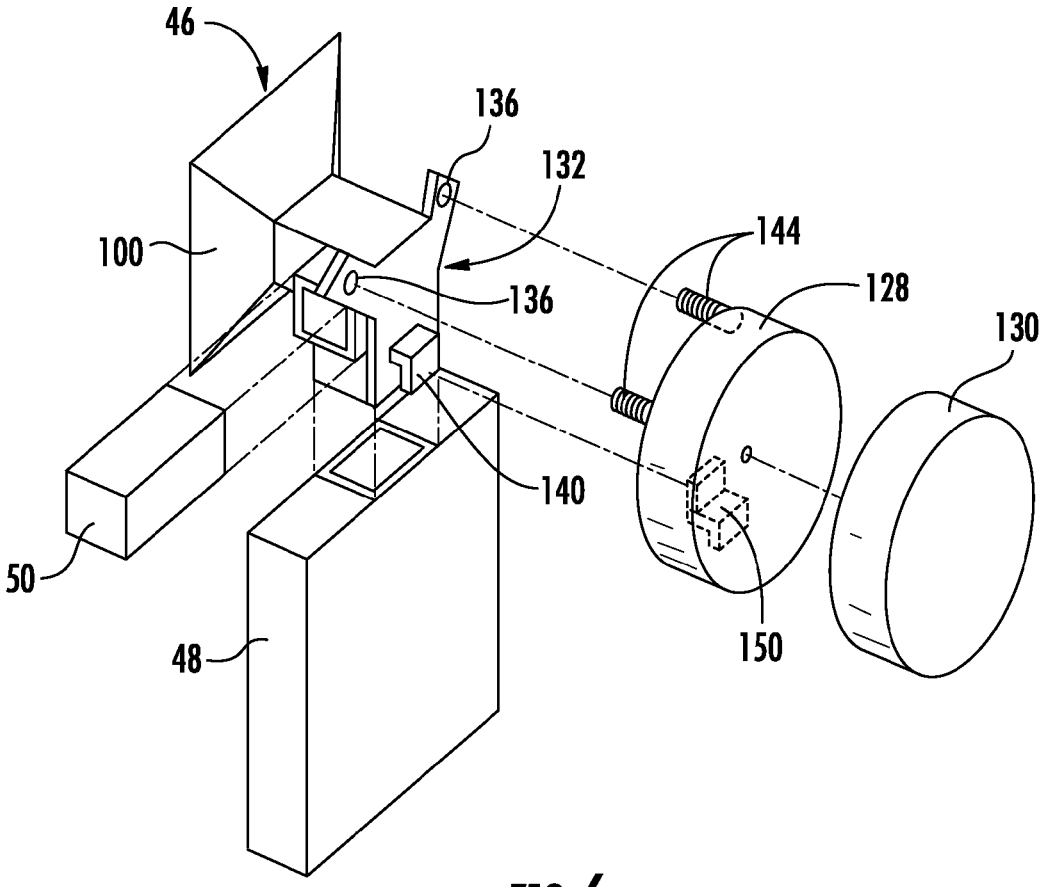
FIG. 6 is a partially exploded rear perspective view of the horn/OMT/waveguide of the inflatable antenna assembly of FIG. 1, showing a portion of the exemplary gimbal of FIG. 5.
Figure 7:
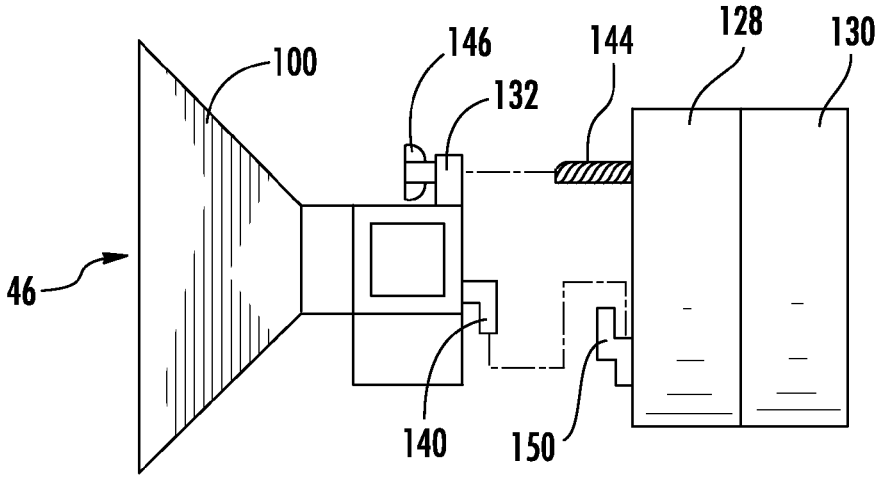
FIG. 7 is a partially exploded side view of the exemplary horn/OMT/waveguide and the portion of the exemplary gimbal as shown in FIG. 6.

FIGS. 6 and 7 show the mounting of the horn/OMT/waveguide 46 to the tripod base 56. Specifically, the horn/OMT/waveguide 46 is mounted to the front, polarity rotation plate 128 of the tripod base 56. In the embodiment shown, a bracket 132 is provided on the back of and may be integral to the horn/OMT/waveguide 46 (shown only in FIGS. 6 and 7). The bracket 132 includes two holes 136 on spaced arms at the top, and a downward facing hook 140 at the bottom. The holes 136 are spaced to receive bolts 144 extending from the polarity rotation plate 128. Captured thumb nuts 146 (FIG. 7) are provided on the bracket 132 for tightening the horn/OMT/waveguide 46 to the polarity rotation plate 128. At the bottom of the polarity rotation plate 128 is an upward facing hook 150. The downward facing hook 140 of the horn/OMT/waveguide 46 is received in the upward facing hook 150 of the polarity rotation plate 128 to secure the bottom of the horn/OMT/waveguide 46 to the bottom of the polarity rotation plate 128. A gasket may be used to provide and airtight connection if an alternative configuration is used in which inflation gas is provided through the horn/OMT/waveguide 46. The horn/OMT/waveguide 46, transmitter 48, and receiver 50 are located close to the mounting point of the antenna 40 (the mounting frame 90, right behind the main reflector 60) to reduce the required torque the gimbal 120 must apply to maintain the position of the antenna 40, and this allows decreasing the size and weight of the gimbal 120, particularly if the antenna 40 is to be used as a motorized steerable unit.

The horn/OMT/waveguide 46 in some embodiments may be made of a lightweight material, such as but not limited to, for example, a composite, aluminized plastic or styrene, carbon fiber reinforced epoxy, other materials that can have a reflective surface applied to them, or metal. The horn/OMT/waveguide 46 may be coated on the inside with an RF reflective substance, such as, but not limited to, vaporized aluminum.

Figure 8:
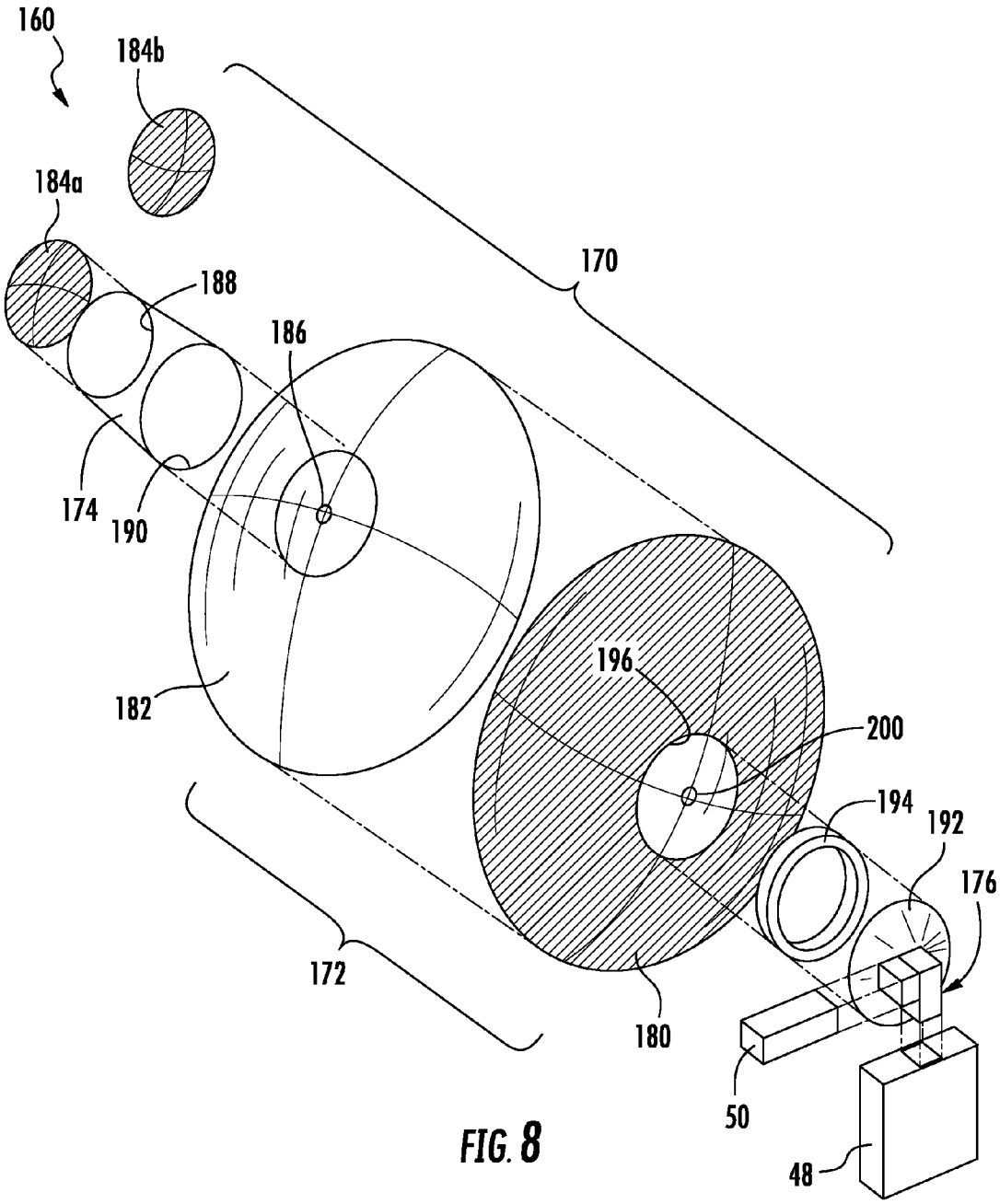
FIG. 8 is an exploded perspective view of a second embodiment of an inflatable antenna assembly.

The antenna shape is not limited to rectangular, but may be other shapes as well. For example, FIG. 8 shows an embodiment of an inflatable antenna assembly 160 including an antenna 170 that is substantially circular in one plane, with an inflatable dish 172 and support member 174. The antenna assembly 160 also includes a horn/OMT/waveguide 176, transmitter 178, and receiver 180. Again, the antenna dish includes at least an RF reflective membrane at the rear that is the main reflector 180, and an RF transparent membrane 182 at the front.

The dish 172 defines an interior volume. The main reflector 180 is concave frontward. In addition to the main reflector 180, the inflatable support member 174 supports a subreflector **184*a* that is, once again, RF reflective and may be an RF reflective membrane provided at the end of the support member 174. The support member 174 may also be a membrane, and with the subreflector 184*a* defines an interior volume that is in fluid communication with the interior volume of the dish, which occurs in the example shown through an opening 186 between the two interior volumes to effectively create a larger interior volume. The support member 174 in this embodiment has a substantially frustoconical shape, as it tapers from back to front, with substantially circular front 188 and rear 190. The support member 174 is RF transparent. The subreflector 184*a* is at the front end 188 of the support member 174 and may be substantially circular as well. The subreflector 184*a* may be concave toward the dish 172, resulting in a dish 172 and subreflector 184*a* that are concave toward each other to form a Gregorian antenna. Alternatively, the subreflector may take the shape shown as the second subreflector 184*b* in FIG. 2, which is convex toward the dish 42, while the dish 42 remains concave toward the subreflector 184*b*. As discussed with respect to the previous convex subreflector 70*b*, this results in a dish 42 and subreflector 184*b* that form a Cassegrain antenna. The materials may be selected and the antenna 170 may be fabricated as previously described for the rectangular antenna 40**.

The transmission and reception elements, in this example a transmitter 48 and receiver 50, respectively, are mounted to the horn/OMT/waveguide 176, which includes a horn 192 with a circular opening. A mounting frame 194 may be provided that is attached to the back of the main reflector 180 at a central position with a permanent, airtight bond. In this embodiment, the mounting frame 194 is circular. An RF transparent region 196 on the main reflector 180 may also be circular.

Figure 9:
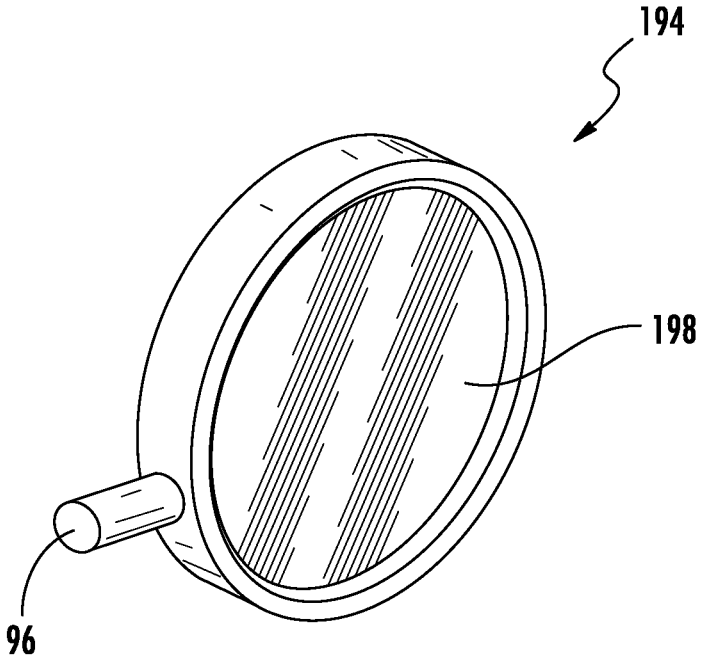
FIG. 9 is a perspective view of an example of a mounting frame of the inflatable antenna assembly of FIG. 8.

As shown in FIG. 9, the mounting frame 194 provides an airtight pressure window 198 and a valve 96 (not shown in FIG. 8) that communicates with the front side of the window. With the mounting frame 194 bonded in place, a source of dry gas or two part foam may be connected to the valve 96. The gas or foam may pass through the valve 96, to the front side of the window, through an opening 200 in the main reflector 180 to inflate the dish 172, and also through the opening 186 between the front, RF transparent membrane 182 of the dish 172 and the back 190 of the support member 174 to inflate the support member 174. The entire antenna 170 may be inflated from one valve 96.

Operation, horn/OMT/waveguide 176 material selection and design, mounting of the mounting frame 194 to the horn/OMT/waveguide 176, and mounting to the horn/OMT/waveguide 176 to the gimbal 120 may be done similarly to that of the rectangular antenna assembly 30 embodiment previously described.

The terminology used herein is for the purpose of describing particular embodiments only and is not intended to be limiting of the disclosure. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Although specific embodiments have been illustrated and described herein, those of ordinary skill in the art appreciate that any arrangement which is calculated to achieve the same purpose may be substituted for the specific embodiments shown and that the embodiments herein have other applications in other environments. This application is intended to cover any adaptations or variations of the present disclosure. The following claims are in no way intended to limit the scope of the disclosure to the specific embodiments described herein.

What is claimed is:

1. An inflatable structure, comprising:

an inflatable membrane for forming the structure;

a first radio frequency (RF) reflective portion integral to the inflatable membrane; and a second RF reflective portion integral to the inflatable membrane;

a horn;

a mounting frame having a perimeter, the mounting frame being attached to the inflatable membrane at the first RF reflective portion around the perimeter of the mounting frame and configured to be releasably secured to an opening of the horn;

a bracket attached to a back of the horn opposite the opening of the horn, the bracket being configured for releasably attaching the inflatable structure to a base support;

wherein, when the membrane is inflated, the first RF reflective portion and the second RF reflective portion oppose each other to form an antenna.

2. The inflatable structure of claim 1, wherein the inflatable membrane is made or assembled to be in one piece.

3. The inflatable structure of claim 1, wherein the first RF reflective portion comprises a main reflector and the second RF reflective portion comprises a subreflector.

4. The inflatable structure of claim 3, wherein the main reflector includes a first concave surface and the subreflector includes a second concave surface, and the first concave surface and the second concave surface are spaced from and oppose each other to form a Gregorian antenna.

5. The inflatable structure of claim 3, wherein the main reflector includes a concave surface and the subreflector includes a convex surface, and the concave surface and the convex surface are spaced from and oppose each other to form a Cassegrain antenna.

6. The inflatable structure of claim 1, wherein the inflatable membrane defines an interior volume, and the mounting frame comprises a valve for a gas or foam source to communicate with the interior volume.

7. The inflatable structure of claim 1, wherein the horn comprises means for admitting gas or foam to the inflatable membrane.

8. The inflatable structure of claim 1, wherein the entirety of the inflatable membrane is initially RF transparent, and RF reflective material is subsequently added to areas of the inflatable membrane to make such areas be the first RF reflective portion and the second RF reflective portion.

9. The inflatable structure of claim 1, wherein the first RF reflective portion is substantially rectangular in one plane.

10. The inflatable structure of claim 1, wherein the first RF reflective portion is substantially circular in one plane.

11. The inflatable structure of claim 1, wherein the inflatable membrane can be compressed and compacted and subsequently inflated one or more times without substantially altering the original inflated shape of the membrane or the reflective efficiency of the first RF reflective portion and the second RF reflective portion.

12. The inflatable structure of claim 1, wherein the bracket is integral to the horn.

13. The inflatable structure of claim 1, wherein the horn comprises a waveguide that is connectable to a receiver or transmitter.

14. An inflatable antenna, comprising:

an inflatable dish including a radio frequency (RF) reflective main reflector and an opposing RF transparent dish wall, each of the main reflector and the opposing RF transparent dish wall having an exposed, exterior surface;

an RF transparent support member, extending from the RF transparent dish wall away from the main reflector to a free end; and an RF reflective subreflector proximate and attached to the free end of the RF transparent support member, wherein the support member is inflatable and the subreflector is inflatable or maintains its shape when the support member is not inflated; wherein, when the inflatable dish and the support member are inflated, the main reflector and the subreflector oppose each other to reflect RF energy toward each other to form an antenna.

15. The inflatable antenna of claim 14, wherein the main reflector and the RF transparent dish wall define a dish interior volume, the subreflector and the RF transparent support member define a support member interior volume, and the dish interior volume and the support member interior volume are in fluid communication.

16. The inflatable antenna of claim 14, wherein the main reflector includes an interior surface that is concave and the subreflector includes an interior surface that is concave, and the main reflector interior surface and the subreflector interior surface oppose each other to form a Gregorian antenna.

17. The inflatable antenna of claim 14, wherein the main reflector includes an interior surface that is concave and the subreflector includes an interior surface that is convex, and the main reflector interior surface and the subreflector interior surface oppose each other to form a Cassegrain antenna.

18. The inflatable antenna of claim 14, wherein the main reflector includes an exterior surface, and further comprising transmission and receiving means and attachment means for mounting the main reflector to the transmission and receiving means, and the attachments means comprises a mounting frame with a perimeter, the mounting frame being attached to the main reflector around the perimeter and on the exterior surface of the main reflector.

19. The inflatable antenna of claim 14, wherein the inflatable dish, support member, and subreflector can be compressed and compacted and subsequently inflated one or more times without substantially altering the original inflated shape of the inflatable dish, support member, and subreflector or the reflective efficiency of the main reflector and the subreflector.

20. A method of making an inflatable antenna, comprising:

providing material for forming an inflatable structure;

causing a first portion of the material to be RF reflective and leaving an opposing, second portion RF transparent, each of the first portion and the second portion having an exposed, exterior surface;

providing an RF transparent support member, extending from the second portion;

causing a portion of the support member to be RF reflective; and assembling the material to form an inflatable membrane;

wherein, when the membrane is inflated, the first portion and the second portion oppose each other to form an antenna.

21. The method of claim 20, wherein, when the membrane is inflated to define an interior volume, the first portion and the second portion form surfaces have curvatures toward the interior volume and to each other to form a Gregorian antenna or a Cassegrain antenna.

* * * * *